US009341373B2

(12) United States Patent
Wilson et al.

(10) Patent No.: US 9,341,373 B2
(45) **Date of Patent: *May 17, 2016**

(54) AIR BLOCKER RING ASSEMBLY WITH BLOCKER RING PROTRUSIONS

(75) Inventors: Jonathan C. Wilson, San Diego, CA (US); Bruno E. Struck, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 1046 days.

This patent is subject to a terminal disclaimer.

(21) Appl. No.: 13/435,827

(22) Filed: Mar. 30, 2012

(65) Prior Publication Data

US 2013/0256431 A1 Oct. 3, 2013

(51) Int. Cl.
*B05B 7/10* (2006.01)
*F23R 3/28* (2006.01)

(52) U.S. Cl.
CPC ..... *F23R 3/28* (2013.01)

(58) Field of Classification Search
CPC ..... F23R 3/28; F23R 3/283
USPC ..... 239/600, 587.1, 587.3, 587.4, 587.5, 239/533.2, 399; 60/776, 737
See application file for complete search history.

(56) References Cited

U.S. PATENT DOCUMENTS 5,836,163 A * 11/1998 Lockyer ..... F23D 11/107 239/405
8,291,706 B2 * 10/2012 Tanner ..... F23C 5/02 239/587.1
2007/0074518 A1 * 4/2007 Rogers ..... F23R 3/286 60/776
2012/0228397 A1 * 9/2012 Thomson ..... F23R 3/28 239/13
2014/0339339 A1 * 11/2014 Prociw ..... F23R 3/28 239/406

OTHER PUBLICATIONS

Prior Art Blocker Ring Assembly (Prior to Mar. 29, 2012), 3 pages.

* cited by examiner

*Primary Examiner* — Len Tran
*Assistant Examiner* — Joel Zhou
(74) *Attorney, Agent, or Firm* — Finnegan, Henderson, Farabow, Garrett & Dunner, LLP

(57) ABSTRACT

An air blocker ring assembly includes a proximal end, a distal end, a blocker ring, and a blocker ring support. The blocker ring has a first protrusion, a second protrusion, and a third protrusion. The blocker ring support has a recess. The first protrusion of the blacker ring is received in the recess. The blocker ring is circumferentially discontinuous about a circumferential slot. At least a portion of the first protrusion is located circumferentially opposite the slot, and the second and third protrusions terminate at the slot.

12 Claims, 6 Drawing Sheets

AIR BLOCKER RING ASSEMBLY WITH BLOCKER RING PROTRUSIONS

TECHNICAL FIELD

The present disclosure relates generally to an air blocker ring assembly, and more particularly, to an air blocker ring assembly having a blocker ring with protrusions.

BACKGROUND

Internal combustion engines, including turbine engines, have fuel injectors or fuel nozzles that inject liquid and/or gaseous fuel for mixing with compressed air and subsequent combustion in a combustion chamber of the engine. One such fuel injector is discussed in U.S. Patent Application Publication No. 2007/0074518A ("the '518 publication"). The '518 publication discloses a fuel nozzle including a barrel housing connected at one end to an air inlet duct for receiving compressed air, and on the opposing end to a mixing duct for communication of the fuel/air mixture with the combustor of the turbine engine. The fuel injector also includes a central body, a pilot fuel assembly, and a swirler. The central body and the pilot fuel assembly may be disposed radially inward of the barrel housing and aligned along a common axis. The pilot fuel assembly extends within the central body and is configured to inject a pilot stream of pressurized fuel into the combustor to facilitate engine starting, idling, cold operation, and/or lean burn operations of the turbine engine. The swirler is radially disposed between the barrel housing and central body.

The air inlet duct of the fuel injector includes a tubular arrangement configured to axially direct compressed air from the compressor section of the turbine engine into the barrel housing of the fuel injector. Air inlet duct 14 may include a central inlet opening and a flow restrictor located within the central inlet opening at a proximal end of the barrel housing. This flow restrictor (or blocker ring) extends circumferentially around the central inlet opening. The radial distance that the blocker ring protrudes into central inlet opening determines the amount of compressed air received within fuel injector through the air inlet duct. Thus, the size of the blocker ring affects the amount of air that is combusted in the combustor of the engine.

SUMMARY

In one aspect, the present disclosure is directed to an air blocker ring assembly including a proximal end and a distal end, a blocker ring including a protrusion, and a blocker ring support having a recess. The protrusion of the blocker ring is received in the recess.

In another aspect, the present disclosure is directed to an air blocker ring assembly for an air inlet of a fuel injector including a proximal end and a distal end, a blocker ring having a protrusion, and a blocker ring support having wall portion. The protrusion and the wall portion cooperating to inhibit relative rotation between the blocker ring and the blocker ring support.

In another aspect, the present disclosure is directed to an air blocker ring assembly for an air inlet of a fuel injector including a proximal end and a distal end, a blocker ring including a body portion and three protrusions extending radially from the body portion, and a blocker ring support having a recess and two circumferential ends. A first of the three protrusions of the blocker ring is received in the recess, a second of the three protrusions of the blocker ring abutts a first of the circumferential ends of the blocker ring support, and a third of the three protrusion of the blocker ring abut a second of the circumferential ends of the blocker ring support.

DETAILED DESCRIPTION

Figure 1:
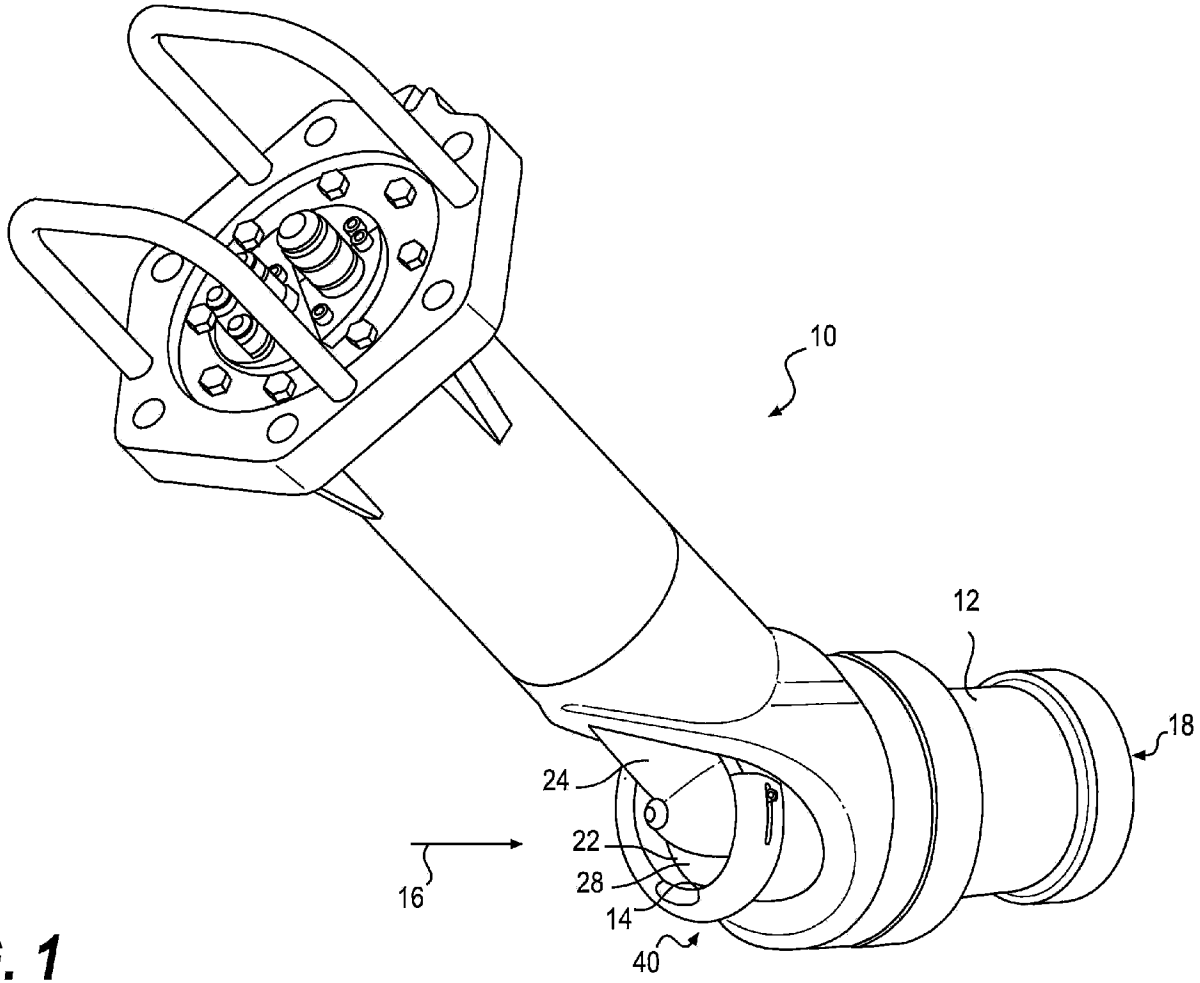
FIG. 1 illustrates a fuel injector of a turbine engine in accordance with an exemplary embodiment of the present disclosure.

FIG. 1 illustrates an exemplary fuel injector or fuel nozzle 10 of an engine, such as a gas turbine engine. The engine may be associated with a stationary or mobile machine configured to accomplish a predetermined task. For example, the engine may embody the primary power source of a generator set that produces an electrical power output, or of a pumping mechanism that performs a fluid pumping operation. The engine may alternatively embody the prime mover of an earth-moving machine, a passenger vehicle, a marine vessel, or any other mobile machine known in the art. When in the form of a gas turbine engine, the engine may include a compressor section, a combustor section, a turbine section, and an exhaust section (not shown).

The combustor section of such a gas turbine engine may mix fuel with compressed air from the compressor section and combust the mixture to create a mechanical work output. Specifically, the combustor section may include a plurality of fuel injectors 10 annularly arranged about a central shaft, and an annular combustion chamber associated with fuel injectors 10. Each fuel injector 10 may inject one or both of liquid and gaseous fuel into the flow of compressed air from the compressor section for ignition within the combustion chamber. As the fuel/air mixture combusts, the heated molecules may expand and move at high speed into the turbine section of the turbine engine.

Figure 2:
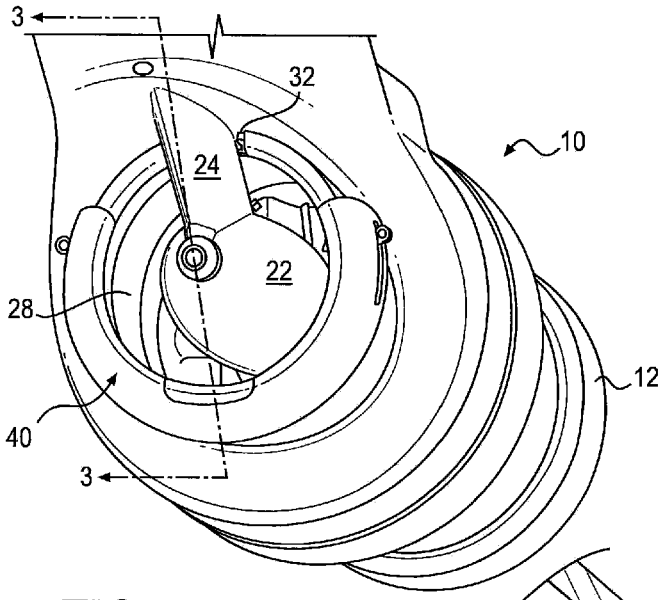
FIG. 2 is an end view of a portion of the fuel injector of FIG. 1.
Figure 3:
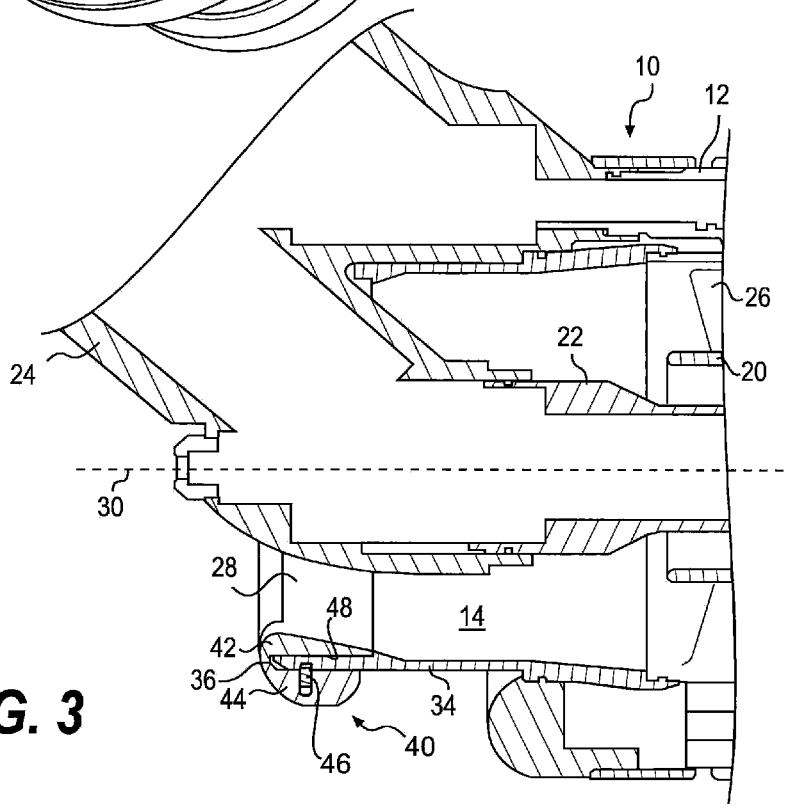
FIG. 3 is a partial cross-section view of a portion of the fuel injector of FIG. 1.

Each fuel injector 10 may include components that cooperate to inject gaseous and/or liquid fuel into the combustion chamber. Specifically, each fuel injector 10 may include a barrel housing 12 connected at one end to an air inlet duct 14 for receiving compressed air 16, and on the opposing end to a mixing duct 18 for communication of the fuel/air mixture with the combustion chamber of the turbine engine. Referring to FIGS. 2 and 3, fuel injector 10 may also include a central body 20, a pilot fuel assembly 22 extending from a pilot strut 24, and a swirler 26 having a swirler extension 34. Central body 20 and pilot fuel assembly 22 may be disposed radially inward of barrel housing 12 and aligned along a common axis 30. Pilot fuel assembly 22 may extend within central body 20 and be configured to inject a pilot stream of pressurized fuel into the combustion chamber to facilitate engine starting, idling, cold operation, and/or lean burn operations of the turbine engine. Swirler 26 may be radially disposed between barrel housing 12 and central body 20.

Air inlet duct 14 of fuel injector 10 embodies a tubular arrangement configured to axially direct compressed air from the compressor section of the turbine engine into barrel housing 12. Air inlet duct 14 may include a central inlet opening 28 and a flow restrictor located within central inlet opening 28 at a proximal end of the barrel housing 12. As disclosed herein, the flow restrictor includes an air blocker ring assembly 40 extending circumferentially around central inlet opening 28. The radial distance that blocker ring assembly 40 protrudes into central inlet opening 28 controls the amount of compressed air received within fuel injector 10 through air inlet duct 14. It is noted, that the use of the term "ring" as used herein does not require a full circumferentially-extending element or assembly, but rather can include components having circumferential discontinuities. For example, blocker ring assembly 40 may be circumferentially discontinuous about a circumferential slot 32 (FIG. 2) to allow the pilot strut 24 to extend through the slot 32.

As shown in FIG. 3, blocker ring assembly 40 includes a blocker ring 42, a blocker ring support 44, and a snap ring 46. Each of these components may be made of the same or different materials that are appropriate for the environment in which they are used. For example, blocker ring 42, blocker ring support 44, and snap ring 46 may be made of stainless steel, such as 316 stainless steel. Blocker ring 42 is located radially inside blocker ring support 44 so as to form an axially-extending groove 48 that is open at a distal end of the blocker ring assembly 40. Blocker ring assembly 40 is coupled to a proximal end of swirler extension 34 by securing the proximal end of the swirler extension 34 in the axially extending groove 48 of the blocker ring assembly 40. Snap ring 46 may be received in aligned radially-extending grooves of both swirler extension 34 and blocker ring support 44 to assist in fixing blocker ring assembly 40 to swirler extension 34. It is understood that the axially-extending groove 48 and snap ring 46 securing arrangement could be replaced with other appropriate securing arrangements.

Figure 4:
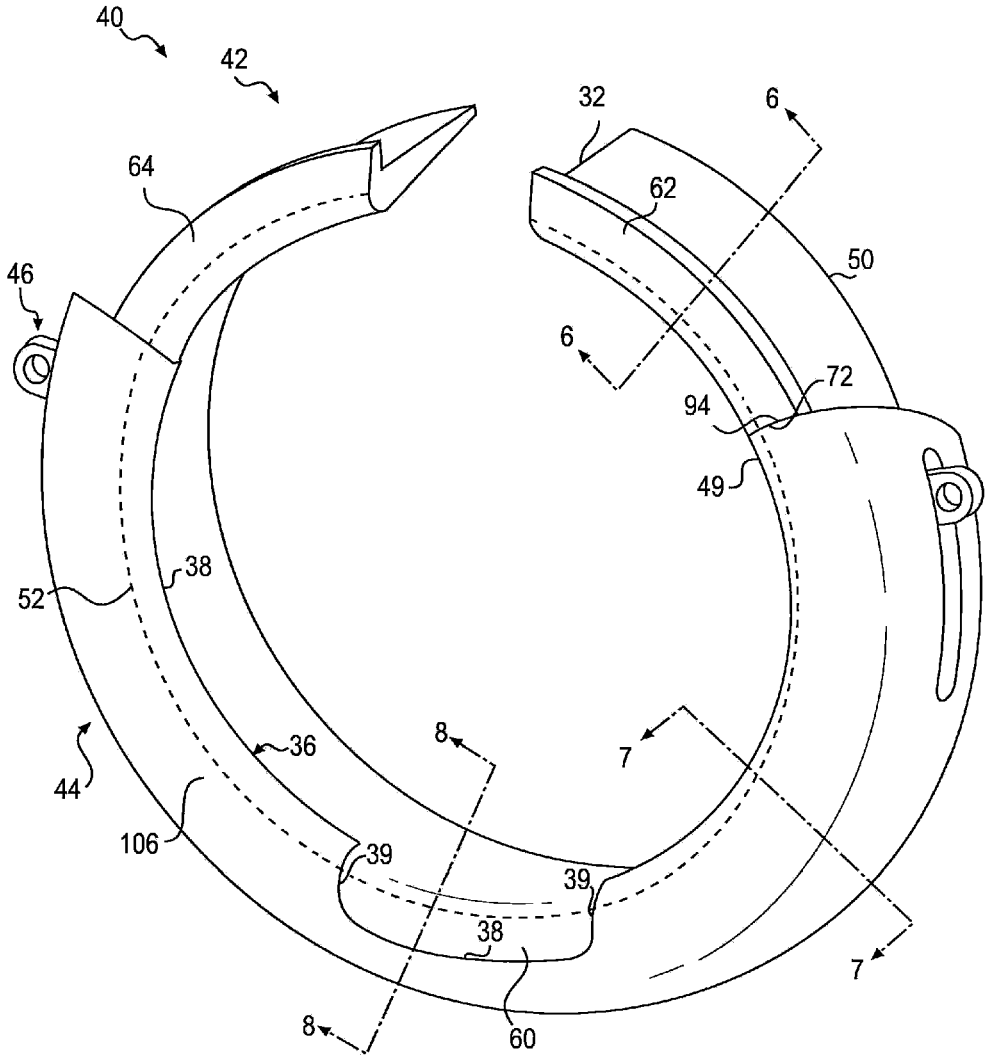
FIG. 4 illustrates an exemplary blocker ring assembly for use in the fuel injector of FIG. 1.
Figure 5:
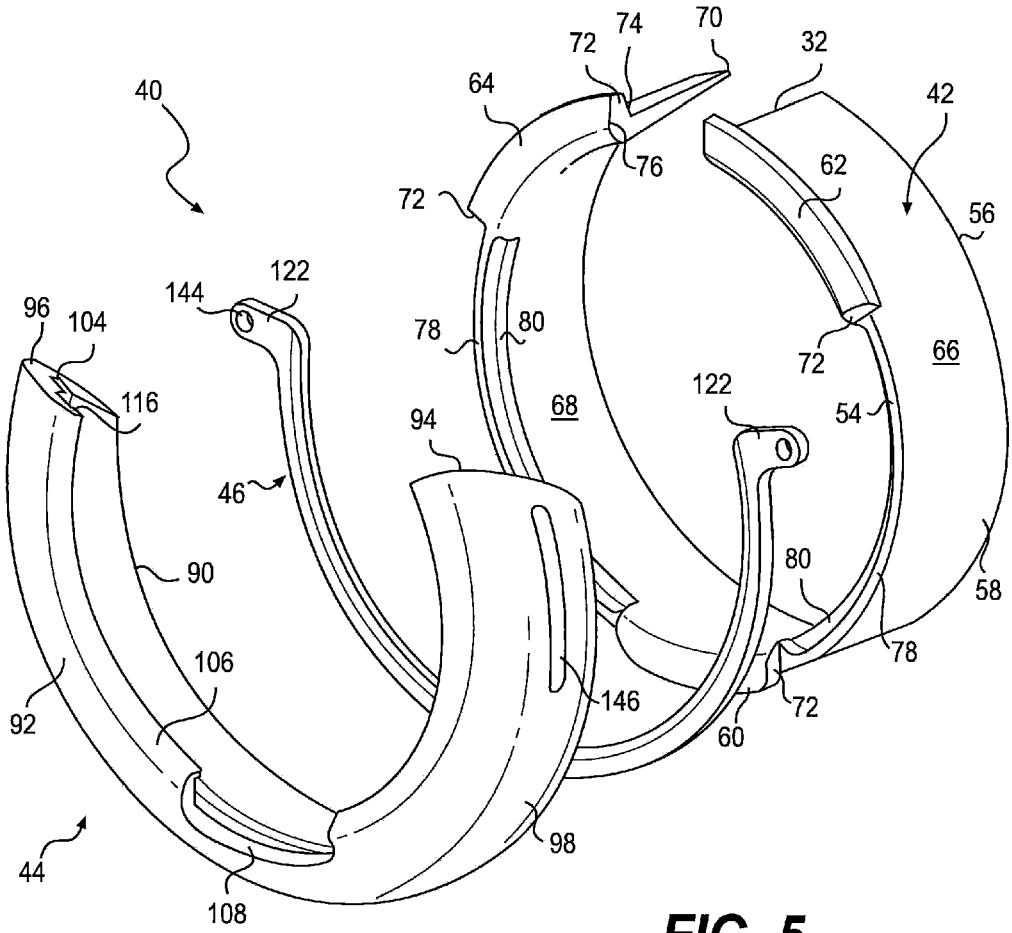
FIG. 5 is an exploded view of the blocker ring assembly of FIG. 4.

Referring now to FIGS. 4 and 5, blocker ring assembly 40 may include a proximal end 49 and a distal end 50. Proximal end 49 includes a leading edge corresponding to the proximal-most end portion of the blocker ring assembly 40. The general area of the leading edge is identified in FIG. 4 with a dashed line 52. As shown, leading edge 52 includes portions of both the blocker ring 42 and the blocker ring support 44, as will be explained in detail below.

As shown in FIG. 5, blocker ring 42 of blocker ring assembly 40 may include a proximal end 54, a distal end 56, a body portion 58, and a plurality of radially-outward extending protrusions 60, 62, 64 that will be discussed in more detail below. As best seen in the cross-section of FIG. 6, body portion 58 includes a constant diameter outer radial surface 66 and a varying diameter inner radial surface 68. Inner radial surface 68 increases in diameter from the proximal end 54 to the distal end 56 so as to form body portion 58 with a generally tapering cross-section from the proximal end 54 to the distal end 56. The distal end 56 of blocker ring 42 includes a planar surface 70 normal to the outer radial surface 66. It is understood that the shape of blocker ring 42 discussed above is exemplary only, and other shapes may be used. For example, the diameter of the inner radial surface 68 at the proximal end 54 of the blocker ring 42, and thus the maximum radial thickness of blocker ring 42, may vary depending on the amount of flow restriction desired for a given engine or operating environment.

Figure 10:
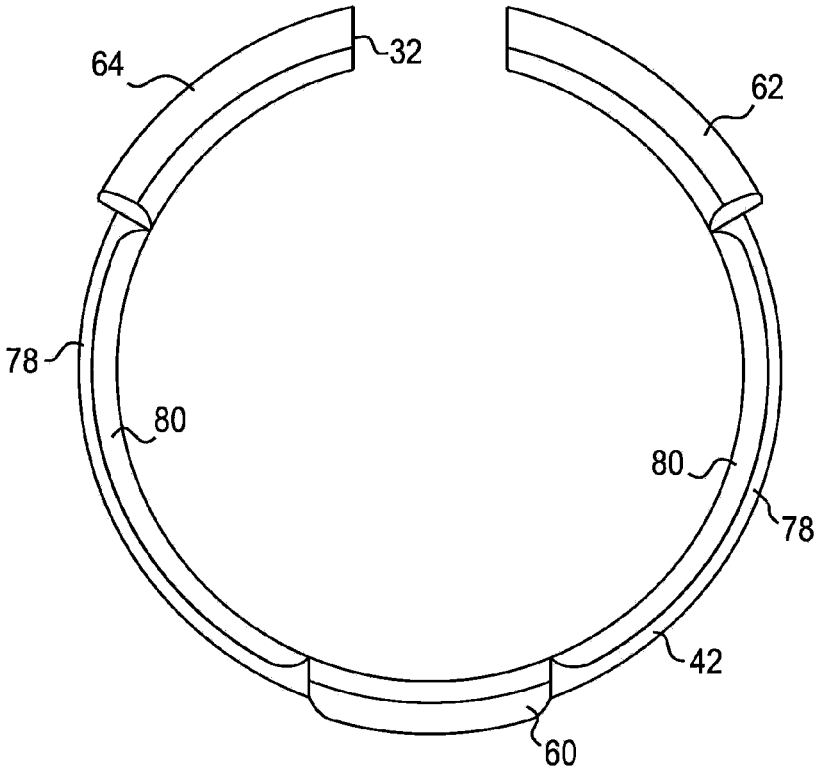
FIG. 10 is a proximal end view of a blocker ring of the blocker ring assembly of FIG. 4.

Referring back to FIGS. 4 and 5, the proximal end 54 of blocker ring 42 includes the plurality of radially-outward extending protrusions 60, 62, 64. Protrusions 60, 62, 64 may be formed as radially-extending tabs that extend over different circumferential arc segments at different circumferential positions along proximal end 54 of blocker ring 42. For example, protrusion 60 may be located circumferentially opposite slot 32 of the proximal ring assembly 40. Protrusions 62 and 64 may extend from slot 32 in both the clockwise and counter-clockwise directions and terminate approximately the 2:30 and 10:30 clock-based positions, respectively. As shown in FIG. 10, protrusion 60 may extend over a smaller circumferential arc than protrusions 62 and 64. It is understood that the number, location, and shape of protrusions 60, 62, 64 discussed above are exemplary only, and more or less protrusions may be used, and that different locations and shapes can be implemented. For example, protrusions 62 and 64 could be omitted and/or the size and location of protrusion 60 could be different from that shown in the figures.

Referring to FIG. 5, protrusions 60, 62, 64 may have planar circumferential ends 72, and planar distal surfaces 74. The proximal end 54 of body portion 58 at the protrusions 60, 62, 64 form a convexly-shaped proximal surface 76. This convexly-shaped proximal surface 76 forms a part of the leading edge 52 discussed above with respect to FIG. 4.

Figure 7:
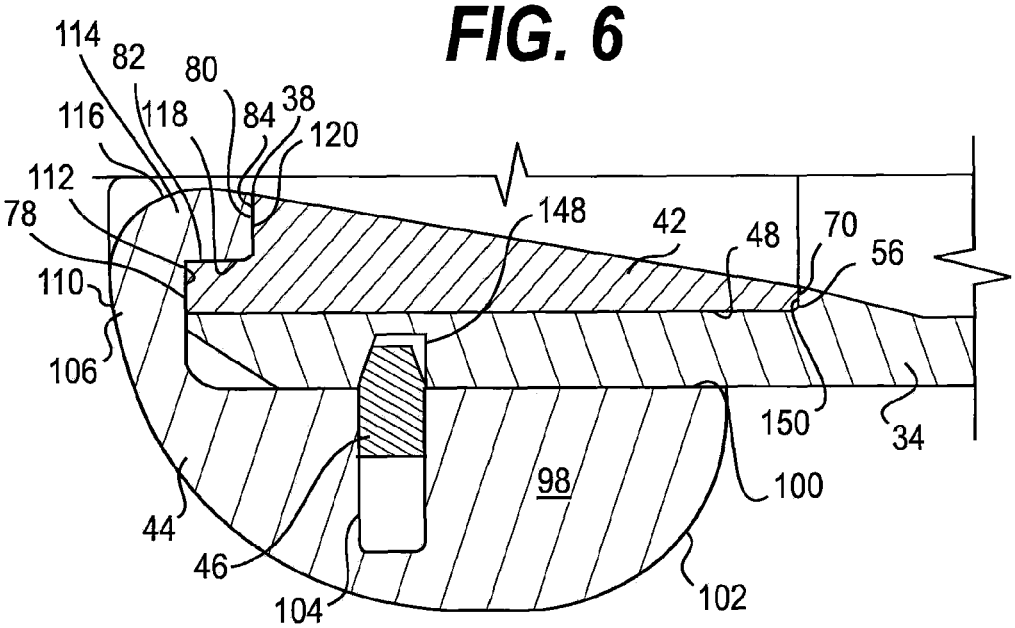

Between protrusions 60 and 62, and 60 and 64, the blocker ring 42 includes planar proximal surfaces 78, as shown in FIGS. 5 and 7. These planar proximal surfaces 78 extend normal to outer radial surface 66 of blocker ring 42. Blocker ring 42 also includes a radial step or groove 80 located axially inward of planar proximal surfaces 78. Radial step 80 includes a planar, axially extending surface 82 and a planar, radially extending surface 84. These surfaces 82 and 84 are normal to one another, and axially-extending surface 82 is normal to proximal surface 78. FIG. 10 shows a proximal end view of blocker ring 42 and the circumferential positions of protrusions 60, 62, and 64, proximal surfaces 78, and radial steps 80.

Referring again to FIG. 5, blocker ring support 44 is generally C-shaped circumferentially and includes a distal end 90, a proximal end 92, and two circumferential ends 94, 96. As best seen in the cross-sections of FIGS. 7 and 8, blocker ring support 44 further includes a body portion 98, having a planar inner radial surface 100 and a generally convex outer radial surface 102. Inner radial surface 100 includes a groove 104 extending into body portion 98 normal to the inner radial surface 100. Blocker ring support 44 further includes a proximal end portion 106 located proximal the body portion 98. With the exception of a recess 108 (FIG. 5) in the proximal end portion 106 of blocker ring support 44, the proximal end portion 106 extends radially inwardly and includes a convexly curved outer surface 110 and a planar, radially extending inner surface 112.

As seen in the cross-section of FIG. 7, a protrusion or flange 114 extends distally from proximal end portion 106 of blocker ring support 44. Flange 114 includes a convexly curved radially inner surface 116, a planar radially outer surface 118, and a planar distal end surface 120. Radially outer surface 118 and planar distal end surface 120 of flange 114 are shaped to mate with radial step 80 formed in blocker ring 42, such that the radially outer surface 118 overlaps axially-extending surface 82 of radial step 80. Also, planar distal end surface 120 of flange 114 may be located directly opposite radially-extending surface 84 of radial step 80 of blocker ring 42.

Figure 8:
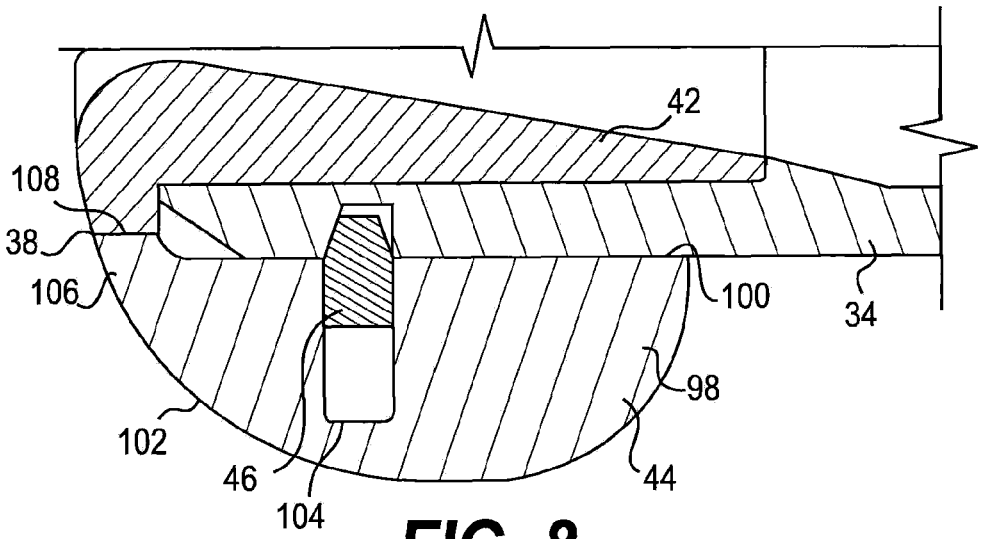
Figure 9:
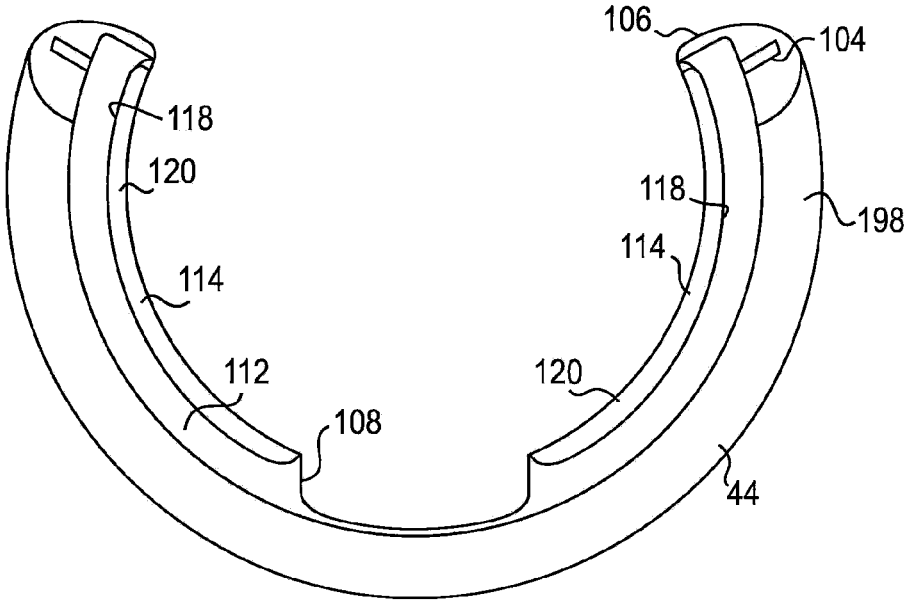
FIG. 9 is a distal end view of a blocker ring support of the blocker ring assembly of FIG. 4.

Protrusion or flange 114 of blocker ring support 44 extends along a majority of the circumference of blocker ring support 44. As best shown in the distal end view of blocker ring support 44 in FIG. 9, recess 108 formed in the proximal end portion 106 of blocker ring support 44 separates the flange 114 into two separate flanges. As identified in FIG. 4, FIG. 8 illustrates the cross-section of the proximal end portion 106 of blocker ring support 44 at the location of the recess 108. It is understood that the number, location, and shape of flanges 114 discussed above are exemplary only, and more or less flanges may be used, and that different locations and shapes can be implemented. For example, flanges 114 and radial steps 80 may be shaped in different complementary configurations from those shown in the figures.

As shown in FIG. 5, snap ring 46 may include a C-shaped ring having laterally extending protrusions 122 at each circumferential end. Laterally extending protrusions 122 may each include an axially extending bore 144. Further, laterally extending protrusions 122 are shaped and positioned to be received within circumferential slots 146 on opposite sides of blocker ring support 44. In addition, snap ring 46 is sized to be received in groove 104 extending into body portion 98 of blocker ring support 44.

The cooperation of blocker ring 42, blocker ring support 44, and snap ring 46 will now be discussed in association with FIGS. 4 and 5. In the assembled state, the protrusions 62 and 64 of blocker ring 42 are positioned so that their circumferential ends 72 that are located opposite circumferential slot 32 are positioned directly opposite circumferential ends 94, 96 of blocker ring support 44. For example, circumferential ends 72 of protrusions 62 and 64 may form wall portions that abut the wall portions of circumferential ends 94, 96 of blocker ring support 44 to limit relative rotation between the blocker ring 42 and the blocker ring support 44. Protrusion 60 may be of the same shape as recess 108 of blocker ring support 44, and protrusion 60 may be received within recess 108. With such an arrangement, wall portions of recess 108 are located directly opposite wall portions of protrusion 60. For example, the wall portion of recess 108 may abut the wall portions of protrusion 60 to again limit relative rotation between blocker ring 42 and blocker ring support 44. Such relative-rotation-limiting features are exemplary only, and it is understood that more or less such features may be used in blocker ring assembly 40. For example, protrusions 62 and 64 could be omitted.

With this configuration of blocker ring 42 and blocker ring support 44, circumferential leading edge 52 (FIG. 4) of blocker ring assembly 40 is formed by both the blocker ring 42 and the blocker ring support 44. For example, circumferential leading edge 52 is formed by protrusions 60, 62, 64, and proximal end portion 106 of the blocker ring support 44. In particular, protrusions 60, 62, 64 form three separate circumferential arc segments of circumferential leading edge 52, with two of the circumferential arc segments extending from the circumferential slot 32 and another segment formed by protrusion 60. Proximal end portion 106 of the blocker ring support 44 forms two circumferential arc segments of leading edge 52, with the segments being separated by the recess 108.

Forming leading edge 52 with portions of both blocker ring 42 and blocker ring support 44 provides a split line 36 (FIG. 4) at the interface of blocker ring 42 and blocker ring support 44 that varies radially at different circumferential positions along blocker ring assembly 40 and avoids circumferentially following leading edge 52. In particular, split line 36 includes a circumferentially extending split line 38 with portions that are located both radially inside and radially outside leading edge 52. Split line 36 also includes radially extending split lines 39 at an interface of the blocker ring 42 and blocker ring support 44, the radially extending split lines 39 connecting the radially inside and radially outside portions of the circumferentially extending split line 38. It is understood that these leading edge details, and corresponding split lines 36, are exemplary only, and that leading edge 52 may be formed by more or less portions of blocker ring 42 and/or blocker ring support 44, and split line 36 can be located only radially inside or only radially outside of leading edge 52. For example, more protrusions 60 could be included, protrusion 60 could be omitted, and/or protrusions 62 and 64 could be omitted with blocker ring support 44 extending to slot 32 of the blocker ring assembly 40.

The mating of blocker ring 42 and blocker ring support 44 also includes protrusions or flanges 114 of blocker ring support 44 being received in radial step 80 of blocker ring 42. In particular, with reference to FIG. 7, radially outer surface 118 of flange 114 radially overlaps and may abut axially extending surface 82 of radial step 80 to assist in radially securing blocker ring 42 in position. Also, planar distal end surface 120 of flange 114 is located directly opposite radially extending surface 84 of radial step 80 of blocker ring 42. For example, planar distal end surface 120 of flange 114 may abut radially extending surface 84 of radial step 80 to assist in axially securing blocker ring 42 into position. In addition, radially extending inner surface 112 of blocker ring support 44 may be configured to abut proximal surface 78 of blocker ring 42 to assist in axially securing blocker ring 42.

Referring again to FIG. 7, assembly of blocker ring 42, blocker ring support 44, and snap ring 46 together provide an axially-extending groove 48 that is open at a distal end of the blocker ring assembly 40. Blocker ring assembly 40 is coupled to a proximal end of the swirler extension 34 by positioning the proximal end of the swirler extension 34 in the axially extending groove 48 of the blocker ring assembly 40. Snap ring 46 may be received in aligned radially-extending grooves 104 and 148 of blocker ring support 44 and swirler extension 34 to assist in fixing blocker ring assembly 40 to swirler extension 34. When secured to swirler extension 34, distal end 56 of proximal ring 42 may be positioned directly opposite a radial step 150 in swirler extension 34. For example, planar surface 70 of distal end 56 of blocker ring 42 may abut a radially extending wall of radial step 150 of swirler extension 34 to assist in axially securing blocker ring 42 in position. It is understood that such axial restrictions are exemplary only, and more or less such axial restrictions may be used. For example, the axial restriction provided by radial step 150 of the swirler extension 34 could be omitted.

INDUSTRIAL APPLICABILITY

The disclosed blocker ring assembly 40 may be applicable to any fuel injector or fuel nozzle of any engine, such as a gas turbine engine, where control of the amount of inlet air provided to the fuel injector 10 is desired. The blocker ring may also be applicable to annular air inlet openings of other system where the control of the amount of inlet fluid is desired. The operation of the blocker ring assembly 40 will now be explained.

Figure 6:
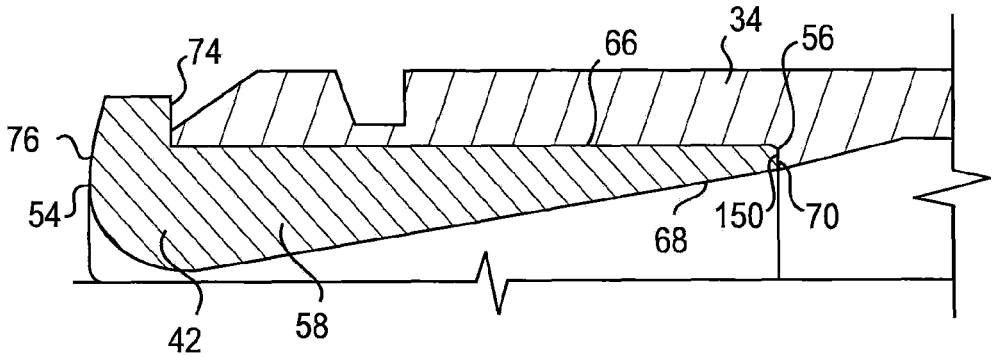
FIGS. 6-8 illustrate various cross-sections of the blocker ring assembly of FIG. 4.

Referring to the cross-sections of FIGS. 3 and 6, blocker ring assembly 40 may be assembled onto proximal end of swirler extension 34 by first positioning blocker ring 42 within an inner diameter of swirler extension 34. Blocker ring 42 may sized to provide a slight interference fit with the inner diameter of swirler extension 34. Blocker ring 42 may be urged distally onto swirler extension 34 so that planar distal surfaces 74 of protrusions 60, 62, 64 abut a planar, proximal-most end of swirler extension 34, while planar surface 70 at distal end 56 of blocker ring 42 abuts radial step 150 of swirler extension 34. Blocker ring 42 is circumferentially positioned so that slot 32 aligns with pilot strut 24 of the fuel injector 10 (FIG. 2).

Referring to the cross-sections of FIGS. 3 and 7, blocker ring support 44 and snap ring 46 are secured to an outer diameter of swirler extension 34. This may be achieved by positioning snap ring 46 within groove 104 of blocker ring support 44 so that laterally extending protrusions 122 at each circumferential end of snap ring 46 are located within circumferential slots 146 on opposite sides of blocker ring support 44. Blocker ring support 44 and snap ring 46 may be urged distally onto swirler extension 34. Blocker ring support 44 may be sized to provide a slight interference fit with the outer diameter of swirler extension 34. Also, snap ring 46 may be sized with a radius slightly smaller than the radius of the outer diameter of swirler extension 34 so that snap ring 46 requires a slight expansion during positioning of blocker ring support 44 onto swirler extension 34. This slight expansion of snap ring 46 can be provided by a generally radial force applied to laterally extending protrusions 122 of snap ring 46. Blocker ring support 44 is axially positioned when snap ring 46 is positioned within radially extending groove 148 of swirler extension 34, and radially extending inner surface 112 of proximal end portion 106 of blocker ring support 44 abuts the proximal-most end of swirler extension 34. In this position, the flange 114 of blocker ring support 44 mates with radial step 80 of blocker ring 42, and snap ring 46 is no longer slightly expanded due to its partial positioning within the reduced diameter section of radially extending groove 148 of swirler extension 34.

The above described mounting of blocker ring assembly 40 onto swirler extension 34 provides for removal of blocker ring assembly 40 during maintenance of fuel injector 10, and allows for replacement of blocker ring assembly 40 with another, differently sized, blocker ring assembly 40 if it is desired to change the flow restriction provided by the blocker ring assembly 40.

As discussed above, blocker ring assembly 40 provides a leading edge 52 (FIG. 4) that corresponds to the proximal end portion of the blocker ring assembly 40. Leading edge 52 includes portions of both the blocker ring 42 and the blocker ring support 44. In particular, protrusions 60, 62, 64 form three separate circumferential arc segments of circumferential leading edge 52, and proximal end portion 106 of blocker ring support 44 forms two circumferential arc segments of leading edge 52. As noted above, forming leading edge 52 with portions of both blocker ring 42 and blocker ring support 44 provides a split line 36 between blocker ring 42 and blocker ring support 44 that varies radially at different circumferential positions along blocker ring assembly 40 and avoids circumferentially following leading edge 52. Such an arrangement of the leading edge 52, and corresponding split line 36, serves to reduce the likelihood that air pressures and velocities at any one position along the leading edge 52 will act to radially separate blocker ring 42 from blocker ring support 44. For example, under certain operating conditions of fuel injector 10, leading edge 52 may experience low velocity and high pressure flow compared to the velocities and flow at central inlet opening 28 of air inlet duct 14 of fuel injector 10. This difference in flow velocity and pressure may provide a lifting force at leading edge 52 urging blocker ring 42 radially away from blocker ring support 44. However, with the leading edge 52 formed of both blocker ring 42 and blocker ring support 44, such lifting forces do not act at the split line 36 between the blocker ring 42 and blocker ring support 44. Thus, the effects of such lifting forces are reduced.

As noted above, and as illustrated in the cross-section of FIG. 7, flanges 114 of blocker ring support 44 radially overlap axially extending surface 82 of radial step 80 of blocker ring 42. Such an arrangement radially restricts blocker ring 42 and thus further reduces the likelihood that blocker ring 42 will radially separate from blocker ring support 44. Flanges 114 also help to resist bending and/or shrinking of blocker ring 42.

The interplay between protrusions 60, 62, 64 of blocker ring 42 and blocker ring support 44 assists in providing a relatively rigid blocker ring assembly 40 and helps prevent relative rotation between blocker ring 42 and blocker ring support 44. Providing a relative rigid blocker ring assembly 40 helps to avoid detrimental bending deformation of the blocker ring 42, especially in those embodiments of blocker ring assembly 40 that include a discontinuity via circumferential slot 32. Preventing relative rotation between blocker ring 42 and blocker ring support 44 via opposing circumferential ends 72 and 94, 72 and 96, and wall portions of recess 108 and protrusion 60, helps to avoid fretting damage due to relative movement between blocker ring 42 and blocker ring support 44.

The mating of blocker ring 42 and blocker ring support 44, and the coupling of these components onto swirler extension 34, also helps to prevent axial movement of blocker ring 42. As discussed above and referring to FIGS. 6-8, this axial constraint of blocker ring 42 is provided by planar distal end surface 74 of protrusions 60, 62, 64 axially abutting the proximal end of swirler extension 34, the axially abutting surfaces 84 and 120, and 78 and 112 of blocker ring 42 and blocker ring support 44, and planar surface 70 of distal end 56 of blocker ring 42 axially abutting radial step 150 in swirler extension 34. Such axial constraints help to avoid detrimental cocking of blocker ring 42, helps to avoid fretting caused by movement of the blocker ring 42 with respect to swirler extension 34 and blocker ring support 44, and provides further support to blocker ring 42 to help avoid bending of blocker ring 42.

It will be apparent to those skilled in the art that various modifications and variations can be made to the blocker ring assembly 40. For example, blocker ring assembly 40 may be formed as a fully circumferential ring without circumferential slot 32 for those fuel injectors that do not have a pilot strut as depicted in FIG. 2. In addition, protrusion 60 of blocker ring 42 may be located at different circumferential positions for different sized blocker ring assemblies 40 so as to readily distinguish the different assemblies and help avoid mismatching of blocker rings 42 of one size assembly with a blocker ring support 44 of a different sized assembly. Other embodiments will be apparent to those skilled in the art from consideration of the specification and practice of the disclosed fuel nozzle. It is intended that the specification and examples be considered as exemplary only, with a true scope being indicated by the following claims and their equivalents.

What is claimed is:

1. An air blocker ring assembly, comprising:

a proximal end and a distal end;

a blocker ring including a first protrusion, a second protrusion, and a third protrusion; and a blocker ring support having a recess, the first protrusion of the blocker ring being received in the recess, wherein the blocker ring is circumferentially discontinuous about a circumferential slot, and at least a portion of the first protrusion is located circumferentially opposite the slot, and the second and third protrusions terminate at the slot.

2. The air blocker ring assembly of claim 1, wherein the first protrusion and the recess are the same shape.

3. The air blocker ring assembly of claim 2, wherein the blocker ring includes a body portion, and the first protrusion includes a tab extending radially from the body portion at the proximal end of the blocker ring assembly.

4. The air blocker ring assembly of claim 3, wherein the second and third protrusions abut circumferential ends of the blocker ring support.

5. The air blocker ring assembly of claim 4, wherein the second and third protrusions each include a tab extending radially from the body portion at the proximal end of the blocker ring assembly.

6. The air blocker ring assembly of claim 5, wherein the blocker ring and the blocker ring support are configured to receive a swirler extension.

7. An air blocker ring assembly for an air inlet of a fuel injector, comprising:

a proximal end and a distal end;

a blocker ring having a first protrusion, a second protrusion, and a third protrusion; and a blocker ring support having a wall portion that forms a portion of a recess of the blocker rind support, the first protrusion and the wall portion cooperating to inhibit relative rotation between the blocker ring and the blocker ring support, wherein the blocker ring is circumferentially discontinuous about a circumferential slot, and at least a portion of the first protrusion is located circumferentially opposite the slot, and the second and third protrusions terminate at the slot.

8. The air blocker ring assembly of claim 7, wherein the blocker ring includes a body portion, and the first protrusion includes a tab extending radially from the body portion at the proximal end of the blocker ring assembly.

9. The air blocker ring assembly of claim 7, wherein the wall portion is located at a circumferential end of the blocker ring support.

10. The air blocker ring assembly of claim 7, wherein wall portion is a first wall portion;

the blocker ring support further includes a second wall portion and a third wall portion, the second and third protrusions and the second and third wall portions cooperating to inhibit relative rotation between the blocker ring and the blocker ring support.

11. The air blocker ring assembly of claim 10, wherein the second and third protrusions each include a tab extending radially from a body portion of the blocker ring at the proximal end of the blocker ring assembly.

12. A fuel injector for a gas turbine engine, comprising:

an air blocker ring assembly for an air inlet of the fuel injector, the air blocker ring assembly including:

a proximal end and a distal end;

a blocker ring including a body portion and three protrusions extending radially from the body portion; and a blocker ring support having a recess and two circumferential ends;

a first of the three protrusions of the blocker ring being received in the recess;

a second of the three protrusions of the blocker ring abutting a first of the circumferential ends of the blocker ring support; and a third of the three protrusions of the blocker ring abutting a second of the circumferential ends of the blocker ring support, wherein the blocker ring is circumferentially discontinuous about a circumferential slot, and at least a portion of the first protrusion is located circumferentially opposite the slot, and the second and third protrusions terminate at the slot.

* * * * *